US005844962A

United States Patent [19]

Kunert

[11] Patent Number: 5,844,962

[45] Date of Patent: Dec. 1, 1998

[54] X-RAY EXAMINATION APPARATUS WITH AN X-RAY SOURCE AND A DIAPHRAGM UNIT CONNECTED THERETO

[75] Inventor: Heinz-Peter Kunert, Tangstedt, Germany

[73] Assignee: U.S. Philips Corporation, New York, N.Y.

[21] Appl. No.: 808,594

[22] Filed: Feb. 28, 1997

[30] Foreign Application Priority Data

Mar. 7, 1996 [DE] Germany ..... 196 08 862.3

[51] Int. Cl.[6] ..... G21K 1/04

[52] U.S. Cl. ..... 378/150; 378/206

[58] Field of Search ..... 378/150, 151, 378/206

[56] References Cited

U.S. PATENT DOCUMENTS

| | | | |
|---|---|---|---|
| 4,464,778 | 8/1984 | Goldmann | 378/151 |
| 4,502,147 | 2/1985 | Michaels | 378/150 |
| 4,766,603 | 8/1988 | Okabe et al. | 378/150 |

FOREIGN PATENT DOCUMENTS

| | | |
|---|---|---|
| 0685200A1 | 6/1995 | European Pat. Off. . |
| 2721789A1 | 12/1995 | France . |
| 2124035A | 11/1972 | Germany . |
| 1313296 | 11/1973 | United Kingdom . |

*Primary Examiner*—Craig E. Church
*Attorney, Agent, or Firm*—Dwight H. Renfrew, Jr.

[57] ABSTRACT

The invention relates to an X-ray examination apparatus, including an X-ray source (3, 4) for generating X-rays and a diaphragm unit (5) which is connected to the X-ray source (3, 4) and includes shutters (6) which can be adjusted by a drive device (11, 12) so as to limit the radiation beam (100, 200) emanating from a first source (1) or from a second source (2), and a control unit (13) which controls the drive device. Correspondence between the radiation fields emanating from both sources can be achieved also in the case of different sizes of the sources; the control unit (13) then controls the drive device (11, 12) in such a manner that the shutters occupy a first position ($h_1$) when limiting the radiation beam (101) from the first source (1) and a second position ($h_2$) when limiting the radiation beam (200) from the second source (2), the first and the second position being such that the respective radiation fields of the first and the second source, as defined by the shutters, have equal size (H).

4 Claims, 2 Drawing Sheets

X-RAY EXAMINATION APPARATUS WITH AN X-RAY SOURCE AND A DIAPHRAGM UNIT CONNECTED THERETO

BACKGROUND OF THE INVENTION

1. Field of the Invention

The invention relates to an X-ray examination apparatus which includes an X-ray source for generating X-rays, an X-ray image pick-up device for picking-up X-ray images, a diaphragm unit which is connected to the X-ray source and includes shutters which can be adjusted by means of a drive device in order to limit the radiation beam emanating from a first source or from a second source, and a control unit which controls the drive device.

2. Description of the Related Art

An X-ray examination apparatus of this kind is known essentially from EP-OS 685 200 as well as from GB 1,313,296, be it without a drive device for the shutters. The diaphragm unit of the known X-ray examination apparatus is provided with a light source which illuminates, via a deflection mirror, the object to be examined. The beam emitted by the light source is limited by the shutters and the field thus illuminated shows the user which area of the patient will be imaged during the subsequent X-ray exposure during which the shutters remain in their respective positions. However, deviations occur between the illuminated field and the field irradiated during the X-ray exposure, because the dimensions of the light source (first source) are substantially larger than those of the focal spot (second source). Consequently, a film exposed during the X-ray exposure could have comparatively large non-exposed parts which could dazzle the observer while viewing the film on a viewing box.

According to GB 1,313,296 such a deviation between the illuminated field and the field irradiated during the X-ray exposure is avoided in that the light from the light source is focused, using a concave mirror, onto an aperture which has the same dimensions as the focal spot and whose optical distance from the shutters is exactly equal to the distance between the focal spot of the X-ray tube and the shutters. However, light is then lost and this comparatively expensive solution also requires additional space within the diaphragm unit.

A similar problem is encountered if the X-ray source comprises an X-ray tube with two focal spots of different size. The exposure field is then enlarged upon a change-over from the smaller to the larger focal spot. From EP-OS 685 200 it is known to displace the primary radiation diaphragm in an X-ray tube with several focal spots of different size situated in different positions in such a manner overall that the X-ray exposure field is not displaced upon a change-over from one focal spot to another. However, because the size of the diaphragm aperture then remains the same, the X-ray exposure field in the case of a large focal spot is larger than when a small focal spot is used.

SUMMARY OF THE INVENTION

It is an object of the present invention to construct an X-ray examination apparatus of the kind set forth in such a manner that the radiation fields do not change upon a change-over from one source to the other. This object is achieved according to the invention in that the drive is controlled by the control unit in such a manner that the shutters occupy a first position when limiting the radiation beam from the first source and a second position when limiting the radiation beam from the second source, the first and the second position being such that the radiation fields from the sources as defined by the shutters always have the same size in the plane of the X-ray image pick-up device.

The invention is based on the idea that the two sources are never simultaneously active. For example, when a given field is illuminated by the light source while the shutters are in a predetermined position, according to the invention it is determined, on the basis of the predetermined geometry of the device, what position must be occupied by the shutters during a subsequent X-ray exposure in order to ensure that exactly the previously illuminated field is exposed to the X-rays. The control unit then controls the drive device for the shutters in such a manner that the shutters move from their first position to the calculated second position upon a change-over from one source to the other.

In a further embodiment of the invention the diaphragm unit includes a light source for illuminating the field irradiated during an X-ray exposure and the control unit is programmed so that upon a change-over to an X-ray exposure the shutters are moved from the first position, associated with the light source, to the second position which is associated with a focal spot of the X-ray source. Because the shutters open so far upon a change-over to an X-ray exposure that exactly the field previously illuminated by the light source is exposed to the X-rays, the optical distance between the light source and the shutters need not be exactly equal to the distance between the focal spot and the shutters as in the known apparatus. Therefore, the light source can be arranged in the position within the diaphragm unit which is most attractive from a construction point of view.

In a further embodiment of the invention, which can also be used in combination with the above embodiment, the X-ray source has at least two focal spots of different size, the control unit being programmed so that the drive device is controlled so as to open the shutters upon a change-over from the larger to the smaller focal spot.

When the X-ray source is replaced by a source of the same type, the distance between the focal spot and the shutters could change, notably if X-ray tubes comprising a glass envelope are used. Such a distance variation causes a larger deviation between the field illuminated by the light source and the X-ray exposure field. In order to reduce these deviations, it was necessary thus far to determine the extent of deviations on the basis of test X-ray images and to adjust the diaphragm unit in dependence thereon. These adjusting operations had to be checked on the basis of further test images until at least approximate correspondence was achieved; these adjusting operations, therefore, were very time-consuming and expensive. This time and effort can be reduced in a further embodiment of the invention in that the control unit is arranged to calculate the positions of the shutters in dependence on geometrical parameters, and that at least one of the parameters can be preset in dependence on a test image. The deviations can then be corrected by software by entering a parameter which can be derived from a test image.

BRIEF DESCRIPTION OF THE DRAWING

The invention will be described in detail hereinafter with reference to the drawing. Therein.

DETAILED DESCRIPTION OF THE PREFERRED EMBODIMENTS

Figure 1:
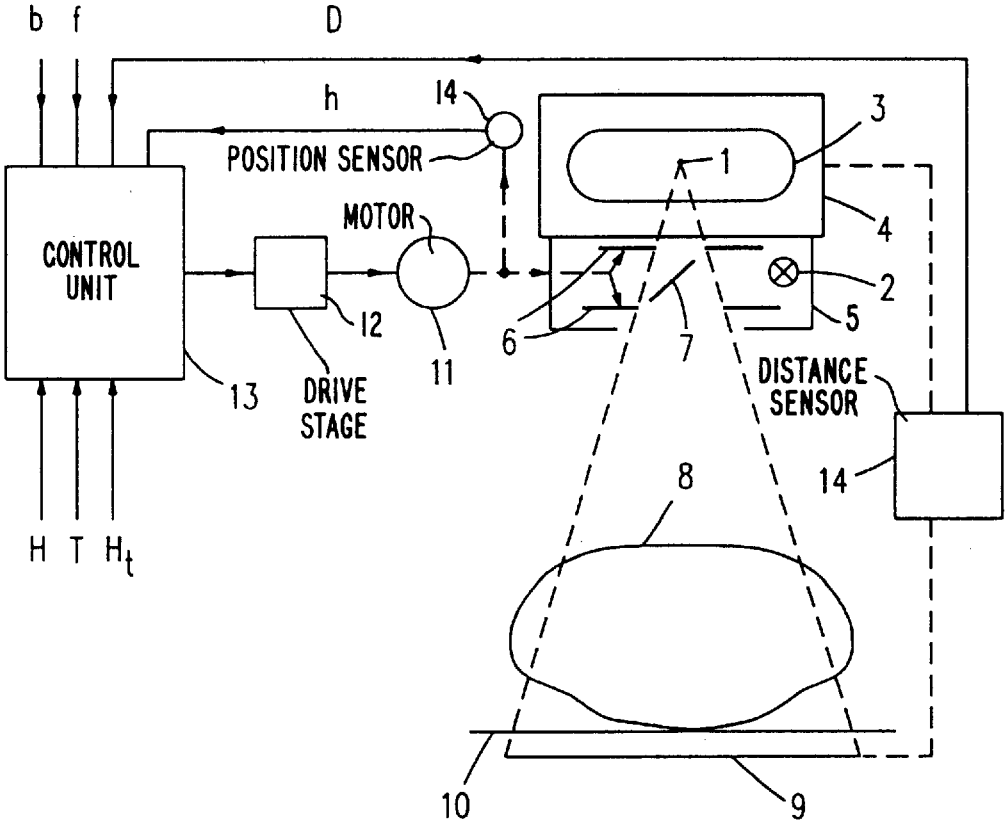
FIG. 1 shows a block diagram of an X-ray examination apparatus according to the invention.

The reference numeral 1 in FIG. 1 denotes the focal spot of an X-ray tube 3 which is accommodated in a housing 4. The size of the focal spot 1 may be switchable or continuously adjustable in known manner.

On the X-ray source formed by the X-ray tube 3 and the housing 4 there is mounted a diaphragm unit 5 which includes shutters 6 which can be adjusted in different planes and are mechanically coupled to one another, said shutters having edges which extend perpendicularly to the plane of drawing and limit the X-ray beam emanating from the focal spot 1 in this direction. The diaphragm unit also includes further shutters (not shown in FIG. 1) which are capable of limiting the radiation beam parallel to the plane of drawing. The diaphragm unit 5 also includes a light source 2 which can illuminate an object 8 to be examined via a deflection mirror 7 which is X-ray transparent or can be moved out of the beam path of the X-ray source 3, thus showing the size of a subsequent X-ray exposure to the user.

The object 8 to be examined is arranged on a table 10 which is only diagrammatically shown; underneath this table there is arranged an image pick-up device 9, for example a film in a cassette. The distance between the object 8 and the X-ray source 3, 4, and hence the distance between the focal spot 1 and the image pick-up device 9, can be adapted to the diagnostic requirements.

Figure 2:
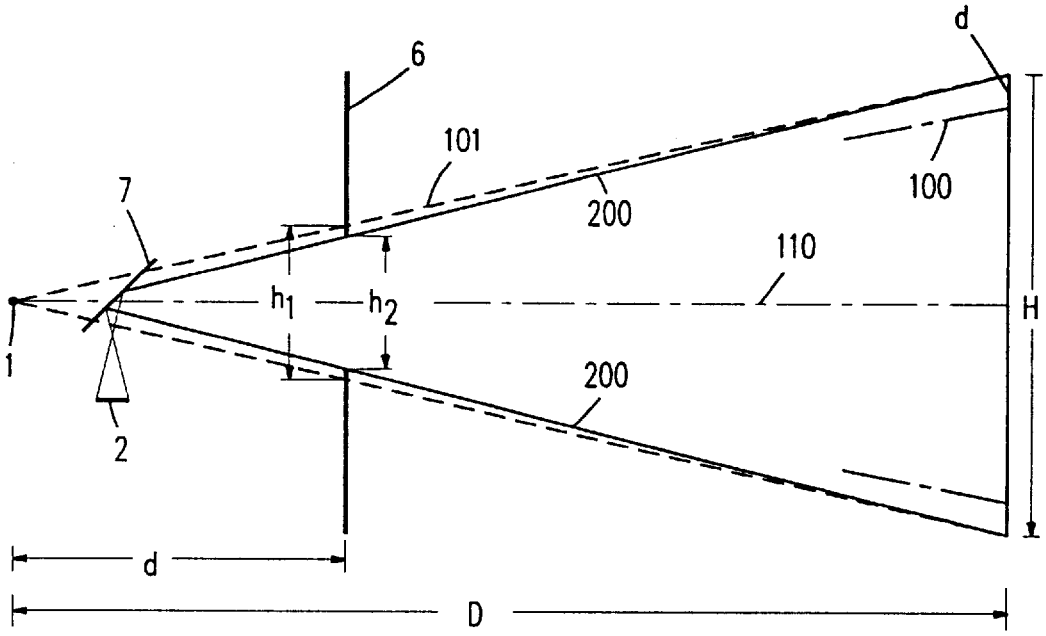
FIG. 2 shows the geometry of such an apparatus.

FIG. 2 shows the geometry of the configuration described thus far, be it not to scale, in order to illustrate the problems encountered. It can be seen that the dimensions of the focal spot 1 are substantially smaller than the light-emissive surface of the light source 2. In practice the dimensions of the effective focal spot of an X-ray tube are 1 $mm^2$ or less, whereas the dimensions of the emissive surface are substantially larger, notably when use is made of a light source having a high intensity and/or a long service life. The edge rays of the beam which is emitted by the light source 2, is deflected by the deflection mirror 7 and is limited by the shutters 6 are denoted by the reference numeral 200 in FIG. 2. These rays define an illuminated field of size H in the film plane, the inwards extending half-shade range of the light not being indicated. The edge rays 100 of the X-ray beam emitted by the focal spot 1, which would occur if the shutters 6 were not changed as customary upon a change-over to an X-ray exposure, are denoted by the dash-dot lines 100 in FIG. 2. The distance between the focal spot 1 and the shutters 6 is denoted by the reference d, whereas the reference D denotes the distance between the focal spot 1 and the plane of the image pick-up device.

It can be seen that the X-ray exposure field defined by the edge rays 100 is smaller than the field defined by the edge rays of the light source 200 if the length of the path of the central ray 110 from the focal spot to the image pick-up device 9 is exactly equal to the length of the path traveled along the central ray 110 by a light ray from the center of the light source 2. The edge rays 101, however, define an X-ray beam whose X-ray exposure field is exactly as large as the field of size H which is illuminated by the light source 2 on the film 9. Accordingly, the aperture $h_1$ which would form the X-ray beam with the edge rays 101 from the focal spot 1 is larger than the aperture $h_2$ of the shutters 6 whereby the same field is illuminated by the light source 2 with the edge rays 200. Thus, if the shutters are opened from the position $h_2$ to the position $h_1$, upon a change-over to an X-ray exposure, the field illuminated by the light source 2 in the one case and the field exposed by the X-ray source in the other case correspond.

How this is achieved will be described with reference to FIG. 1 again. The shutters are adjusted by means of a drive device which includes an adjusting motor 11 and a drive stage 12 which supplies the motor 11 with the necessary power. The drive stage 12 is controlled by a control unit 13 which calculates the respective required aperture h of the shutters and controls the drive stage 12 accordingly. A position sensor 14 is mechanically coupled to the shutters 6; this sensor returns a signal h to the control unit 13 which corresponds to the position of the diaphragm shutters. The control unit compares this signal with its reference value and controls the drive stage 12 accordingly in the case of deviations.

The control unit 13 includes a microcomputer which receives not only the actual position value h but also a signal D which is supplied by a distance sensor 15 which measures the respective distance between the focal spot 1 and the film plane 9 and generates a corresponding signal D. The control unit 13 also receives a signal f which characterizes the size of the focal spot 1 (for example, larger or smaller focus). Furthermore, a signal b informs the control unit 13 about the mode of operation, i.e. whether at the relevant instant an exposure is being made or is to be made or whether the examination field is to be illuminated by means of the light source 2. Furthermore, the diaphragm unit 13 receives a signal H which indicates the size of the image pick-up device 9 and a signal T which indicates whether the position of the shutters is to be governed by the film format or by a so-called object-related setting whereby, using a suitable input member, the operator can preset, a diaphragm aperture which is smaller than the value corresponding to the film format.

If the shutters are to be adjusted in conformity with the format H of the image pick-up device, the control unit 13 calculates a reference value $h_2$ for the shutter adjustment in order to limit the light beam emanating from the light source 2, the calculation being performed using the signals D, H, the size of the light source 2 and the optical distance d (FIG. 2) between the light source and the foremost shutters 6. Furthermore, from the signals f, H, D and d the control unit calculates the shutter position $h_1$ required to expose the format H during the X-ray exposure. Depending on the operating mode signalled by the signal b, the control unit 13 adjusts the shutters either to the aperture $h_1$ or to the aperture $h_2$.

In the case of an object-related adjustment, the operator presets an exposure field which is smaller than the value corresponding to the format of the image pick-up device. First a suitable exposure field is then preset by means of the light source, yielding a given value $h_2$ for the aperture of the shutters, which value is stored by the control unit 13. On the basis of the value $h_2$ and the values d, D and f, the control unit then calculates the shutter position $h_1$ for which the X-ray exposure field would have the same size as the illuminated field. As soon as an exposure is requested, the signal b then changes and instead of the value $h_2$ the control unit 13 supplies the value $h_1$ for the position of the shutters.

As has already been stated, as a result of the invention it is no longer necessary for the light source 2 to be situated at the same optical distance from the shutters 6 as the focal spot 1, because the shutters 6 can always be controlled so that exactly the previously illuminated field is exposed during a subsequent X-ray exposure. The position of the light source 2, therefore, can be determined from a construction point of view. On the other hand, however, it is also possible to operate the apparatus with a different distance d between the focal spot 1 and the shutters 6. Such a difference may be introduced by replacement of the X-ray source, because the position of the X-ray tube relative to the housing 4 and the position of the focal spot relative to the X-ray tube 3 could deviate a few millimeters in X-ray sources of the same type.

Conventional X-ray examination apparatus require elaborate adjusting operations to compensate for the changes of the image field exposed by an X-ray exposure which are caused by the above deviation; moreover, it is necessary to check said adjustments on the basis of a respective test image. In an X-ray apparatus according to the invention, it suffices to make one test image and to enter a correction parameter $H_t$ derived therefrom. This will be described in detail hereinafter with reference to FIG. 3.

Figure 3:
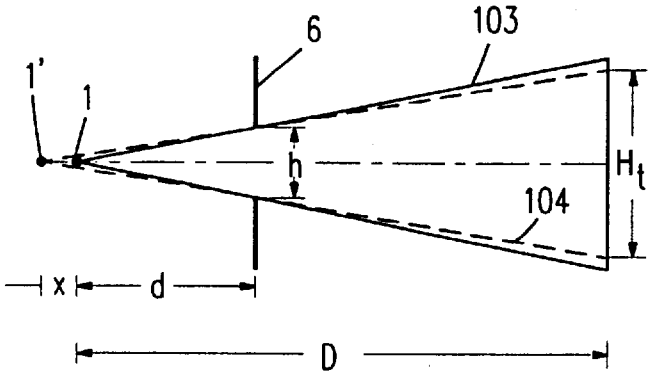
FIG. 3 shows the changes occurring upon a variation of the distance of the focal spot from the shutters.

FIG. 3 shows the geometry in the case of a test image preferably formed by means of the smallest focal spot for which the shutters are adjusted to a predetermined value h and the image pick-up device is arranged at a defined distance D from the focal spot 1. When the focal spot 1 is situated at the predetermined position, i.e. at the distance d from the shutters 6, a radiation field is obtained which has edge rays as denoted by the solid lines 103. However, if replacement of the X-ray tube causes a shift of the focal spot by the amount x with respect to the shutters 6, i.e. to the position 1', the shutters 6 will define an X-ray beam 104 which exposes the test image with a width $H_t$. The shift x can then be calculated, using the value $H_t$ and the predetermined or known values h, d, D, in conformity with the relation $$x = \frac{hD - H_t d}{H_t - h}$$

Thus, after replacement of the X-ray source it is merely necessary to measure the dimensions $H_t$ of the test X-ray image and to enter these dimensions into the control unit 13 which determines the value x therefrom and subsequently bases the calculation of the shutter position $h_1$ for the X-ray beam on the value d+x instead of the value d.

The above equation for x is merely a suitable approximation which is closer as the focal spot is smaller. The focal spot size is taken into account as an additive value which is independent of the dimensions H of the X-ray exposure field. In order to correct even this effect, two X-ray exposures can be performed with the same distance d but with a different aperture; the effect of the focal spot size can be eliminated on the basis thereof. If the focal spot size of the X-ray tube is known, it can already be taken in account for the calculation of the shift x.

I claim:

1. An X-ray examination apparatus comprising:

(a) an X-ray image pick-up device for picking up X-ray images;

(b) a first source of radiation, said first source being a source of X-radiation including at least one focal spot for forming an X-ray radiation beam;

(c) a second source of radiation forming a radiation beam;

(d) a diaphragm unit which includes shutters which can be adjusted in position by means of a drive device in order to define an aperture size limiting the radiation beam formed by either the first source of radiation or by the second source of radiation; and (e) a control unit which controls the drive device, the control unit including means for causing the drive device to automatically move said shutters from a first position defining a first aperture size to a second position defining a second aperture size different from the first aperture size when the radiation beam changes between the first source and the second source, the first and second positions being such that the radiation field due to the X-ray radiation beam from the first source of radiation as limited by the first aperture size has the same size in the plane of the X-ray image pick-up device as the radiation field due to the radiation beam from the second source of radiation as limited by the second aperture size.

2. An X-ray examination apparatus as claimed in claim 1, wherein said second source comprises a light source for illuminating the field irradiated during an X-ray exposure and the control unit is programmed so that upon a change-over to an X-ray exposure the shutters are moved from the first position, associated with the light source, to the second position which is associated with the at least one focal spot of the X-ray source.

3. An X-ray examination apparatus as claimed in claim 1, wherein the X-ray source has at least two focal spots including a larger focal spot and a smaller focal spot, the control unit being programmed so that the drive device is controlled so as to open the shutters upon a change-over from the larger focal spot to the smaller focal spot.

4. An X-ray examination apparatus as claimed in claim 1, wherein the control unit is configured to calculate the positions of the shutters in dependence on geometrical parameters, and that at least one of the parameters can be preset in dependence on a test image.

* * * * *